US007713099B2

(12) United States Patent
Lai

(10) Patent No.: US 7,713,099 B2
(45) Date of Patent: May 11, 2010

(54) ELECTRICAL CONNECTOR

(75) Inventor: Ronald Lai, Bedford, NH (US)

(73) Assignee: Burndy Technology LLC, Manchester, NH (US)

( * ) Notice: Subject to any disclaimer, the term of this patent is extended or adjusted under 35 U.S.C. 154(b) by 0 days.

(21) Appl. No.: 12/283,531

(22) Filed: Sep. 12, 2008

(65) Prior Publication Data

US 2010/0068946 A1 Mar. 18, 2010

(51) Int. Cl.
*H01R 11/01* (2006.01)

(52) U.S. Cl. ..... 439/783

(58) Field of Classification Search ..... 439/783, 439/782, 863, 781, 780, 775, 790, 791
See application file for complete search history.

(56) References Cited

U.S. PATENT DOCUMENTS

| | | | | |
|---|---|---|---|---|
| 1,269,507 | A | 6/1918 | Proctor | |
| 1,278,785 | A | 9/1918 | Tainter | |
| 2,521,192 | A | 9/1950 | Tessmann | 24/122.3 |
| 3,088,993 | A | 5/1963 | Matthysse et al. | 174/71 |
| 4,764,131 | A * | 8/1988 | Beinhaur | 439/781 |
| 4,834,671 | A * | 5/1989 | Vigna et al. | 439/416 |
| 4,857,020 | A * | 8/1989 | Crosby | 439/783 |
| 6,004,165 | A | 12/1999 | Dinh et al. | 439/783 |
| 7,121,868 | B2 * | 10/2006 | Peterson | 439/371 |
| 7,182,653 | B1 | 2/2007 | Hoxha | 439/783 |
| 7,247,061 | B2 | 7/2007 | Hoxha et al. | 439/783 |
| 7,309,263 | B2 * | 12/2007 | Copper et al. | 439/781 |
| 7,341,495 | B1 * | 3/2008 | Ulemek et al. | 439/783 |
| 7,387,546 | B2 * | 6/2008 | Copper et al. | 439/781 |
| 7,494,385 | B2 * | 2/2009 | Copper et al. | 439/770 |
| 7,524,217 | B2 * | 4/2009 | Copper et al. | 439/781 |
| D599,184 | S * | 9/2009 | Johnson et al. | D8/72 |
| 2007/0270046 | A1 | 11/2007 | Copper et al. | 439/781 |
| 2007/0270047 | A1 | 11/2007 | Copper et al. | 439/783 |
| 2008/0050986 | A1 | 2/2008 | Copper et al. | 431/781 |
| 2008/0050987 | A1 * | 2/2008 | Copper et al. | 439/781 |
| 2008/0270047 | A1 * | 10/2008 | Quake et al. | 702/50 |
| 2008/0283686 | A1 * | 11/2008 | Copper | 248/74.1 |
| 2008/0287010 | A1 | 11/2008 | Copper et al. | 439/783 |

* cited by examiner

*Primary Examiner*—T C Patel
*Assistant Examiner*—Vladimir Imas
(74) *Attorney, Agent, or Firm*—Harrington & Smith

(57) ABSTRACT

An electrical connector element including a first section and a second section. The first section has a general hook shape with a first conductor contact surface on an inward facing surface of the general hook shape. The second section is integrally formed with the first section. The second section has a first side forming a second conductor contact surface and an opposite second side. The second side faces the first conductor contact surface. The second side is sized and shaped to slidably interlock directly with another electrical connector element. The second side has at least one wedging surface.

20 Claims, 2 Drawing Sheets

ELECTRICAL CONNECTOR

BACKGROUND OF THE INVENTION

1. Field of the Invention

The invention relates to an electrical connector and, more particularly, to tap or splice electrical connector.

2. Brief Description of Prior Developments

U.S. Pat. No. 1,278,785 discloses a cable clamp with two clamp sections which are longitudinally slid together to wedge cables in a clamping grip. U.S. Pat. No. 7,247,061 discloses a wedge inserted between two C shaped members to clamp two conductors together.

SUMMARY

The following summary is merely intended to be exemplary. The summary is not intended to limit the scope of the claimed invention.

In accordance with one aspect of the invention, an electrical connector element is provided including a first second and a second section. The first section has a general hook shape with a first conductor contact surface on an inward facing surface of the general hook shape. The second section is integrally formed with the first section. The second section has a first side forming a second conductor contact surface and an opposite second side. The second side faces the first conductor contact surface. The second side is sized and shaped to slidably interlock directly with another electrical connector element. The second side has at least one wedging surface.

In accordance with another aspect of the invention, An electrical connector assembly comprising a first one-piece member and a second one piece member. The first one-piece member comprising a first hook shaped section and a first wedging interlock section. The first hook shaped section has a first conductor contact surface on an inward facing side. The first wedging interlock section is located opposite the first conductor contact surface. The first wedging interlock section comprises a second conductor contact surface on an outward facing side of the first wedging interlock section. The second one-piece member comprises a second hook shaped section having a first conductor contact surface on an inward facing side; and a second wedging interlock section located opposite the first conductor contact surface of the second hook shaped section. The second wedging interlock section comprises a second conductor contact surface on an outward facing side of the second wedging interlock section. The second wedging interlock section is directly slidably connected to the first wedging interlock section. The first and second wedging interlock sections are shaped to move the first conductor contact surfaces of the first and second one-piece members towards each other when the first and second one-piece members are slid relative to each other.

In accordance with another aspect of the invention, a method is provided comprising forming a first member with a first section having a general hook shape forming a first conductor contact surface on an interior surface of the general hook shape; and integrally forming a second section having a first side forming a second conductor contact surface and an opposite second side. The second side faces the first conductor contact surface. The second side is sized and shaped to slidably interlock directly with a second member. The second side has two wedging surfaces which are stepped relative to each other.

BRIEF DESCRIPTION OF THE DRAWINGS

The foregoing aspects and other features of the invention are explained in the following description, taken in connection with the accompanying drawings, wherein.

DETAILED DESCRIPTION OF EMBODIMENT

Figure 1:
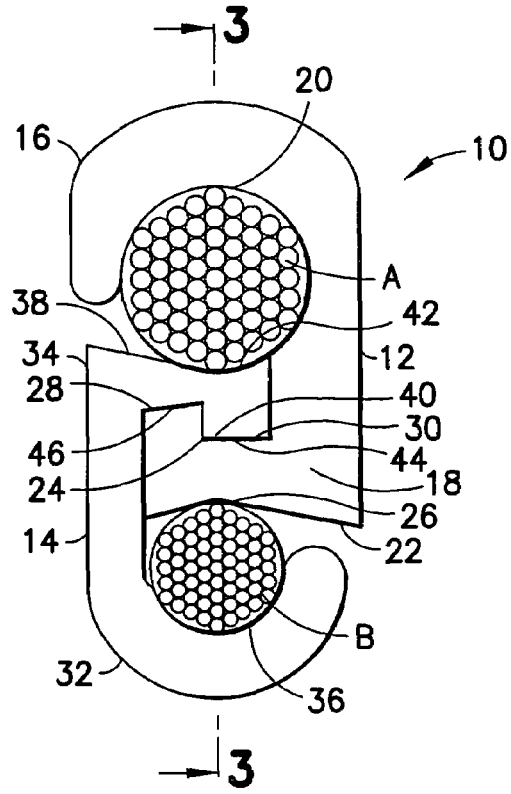
FIG. 1 is an end view of an electrical connector comprising features of the invention shown connecting two conductors to each other.
Figure 2:
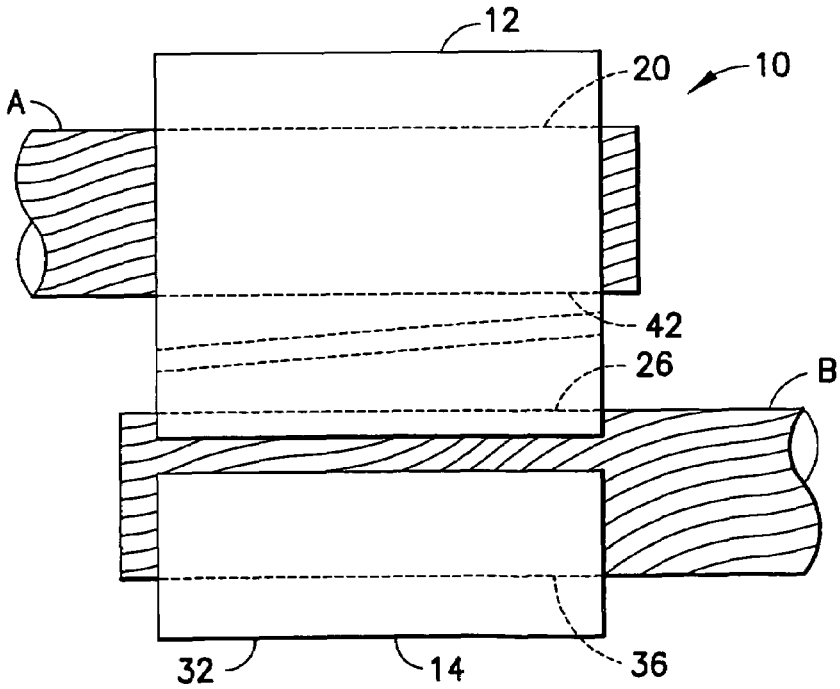
FIG. 2 is a side view of the electrical connector and cables shown in FIG. 1.

Referring to FIGS. 1 and 2, there is shown an end view and a side view, respectively, of an electrical connector 10 incorporating features of the invention. Although the invention will be described with reference to the example embodiment shown in the drawings, it should be understood that the invention can be embodied in many alternate forms of embodiments. In addition, any suitable size, shape or type of elements or materials could be used.

Figure 3:
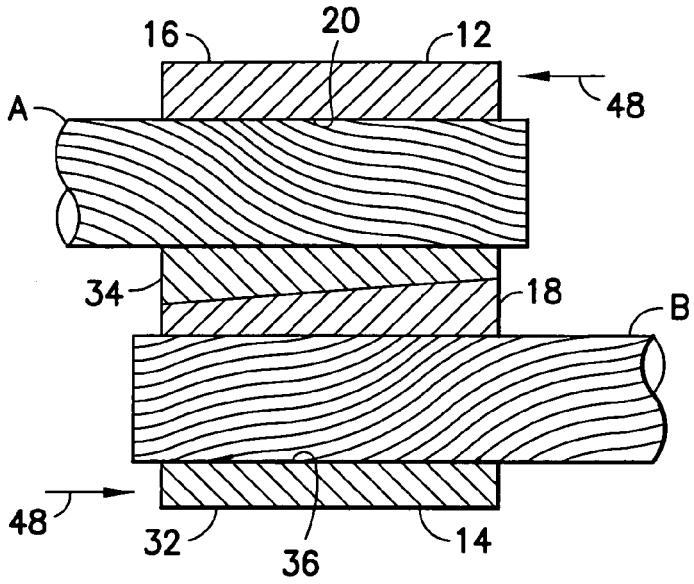
FIG. 3 is a cross sectional view of the electrical connector and cables shown in FIG. 1 taken along line 3-3.
Figure 4:
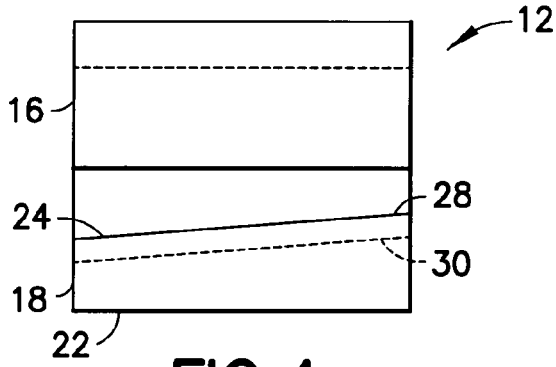
FIG. 4 is a side view of the first one-piece member of the electrical connector shown in FIGS. 1-3.

The connector 10 is a tap or splice electrical connector configured to electrically and mechanically connect two electrical conductors A, B to each other. FIG. 3 shows a cross sectional view of the connector taken along line 3-3 of FIG. 1. The connector 10 comprises a first member 12 and a second member 14. Referring also to FIGS. 3 and 4, the first member 12 is preferably a one-piece member made of metal. The first member 12 has a general cross sectional C shape with a first section 16 and an opposite second section 18. The first section 16 has a general hook shape with a first conductor contact surface 20. The first conductor contact surface 20 is generally concave shaped and faces an inward direction.

Figure 5:
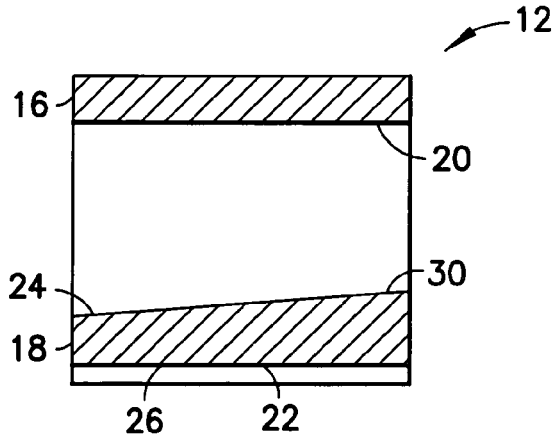
FIG. 5 is a cross sectional view of the first member shown in FIG. 4.

The second section 18 comprises a first side 22 and an opposite second side 24. The first side 22 is located at an outwardly facing exterior side of the first member 12. The first side 22 forms a second conductor contact surface 26 (see FIG. 5 and FIGS. 1 and 2). The second side 24 faces the first conductor contact surface 20. The second side 24 comprises two wedging surfaces 28, 30 (see FIGS. 4 and 5, and FIG. 1). However, in alternate embodiments more or less than two wedging surfaces could be provided. In this embodiment the two wedging surfaces 28, 30 are stepped relative to each other. The second side 24 is sized and shaped to slidably interlock directly with a portion of the second member 14 as seen best in FIG. 1. The wedging surfaces 28, 30 are inclined or angled, but are parallel to each other.

The second member 14 has a general same shape as the first member 12. In one type of embodiment the second member 14 could be identical to the first member 12. However, in an alternate embodiment the general shapes could be different. The second member 14 is preferably a one-piece member made of metal. The second member 14 has a general cross sectional C shape with a first section 32 and an opposite second section 34. The first section 32 has a general hook shape with a second conductor contact surface 36 for contacting the second conductor B. The second conductor contact surface 36 is generally concave shaped and faces an inward direction.

The second section 34 comprises a first side 38 and an opposite second side 40. The first side 38 is located at an outwardly facing exterior side of the second member 14. The first side 38 forms a first conductor contact surface 42 for contacting the first conductor A. The second side 40 faces the second conductor contact surface 36. The second side 40 comprises two wedging surfaces 44, 46. However, in alternate embodiments more or less than two wedging surfaces could be provided. In this embodiment the two wedging surfaces 44, 46 are stepped relative to each other. The second side 40 is sized and shaped to slidably interlock directly with the second section 18 of the first member 12 as seen best in FIG. 1. The wedging surfaces 44, 46 are inclined or angled, but are parallel to each other.

Each member 12, 14 is sized and shaped to connect to a specific size conductor A, B or range of conductor sizes. More specifically, the size of member 12, 14 is selected based upon the size and shape of the conductor contact surface 20, 36 which is needed for the specific size of the conductors being connected to each other. The size and shape of the second sections 18, 34 are the same for any size of the members 12, 14. Thus, a modular type of connector can be provided with the sizes of the first and second members 12, 14 being interchangeably selected dependent upon the size of the conductors A, B. The connector 10 merely comprises only the two members 12, 14, but additional members could be provided.

To assemble the connector 10, the conductors A, B are inserted at the surfaces 20, 36 and the two second sections 18, 34 are slidably interconnected with each other. The two members 12, 14 are slid relative to each other as indicated by arrows 48 in FIG. 3. A tool, such as pliers or a cartridge initiated tool similar to tools currently used with wedge connectors, could be used. The movement of the members 12, 14 in reverse directions 48 causes the wedge surfaces 28, 30 of the first member 12 and the wedge surfaces 44, 46 of the second member 14 to ride along each other. This causes the surfaces 20, 36 to move inward towards their opposite respective conductor surfaces 42, 26. Simultaneously, first side 22 and first side 38 move towards A and B, respectively. Hence, the first conductor A is clamped between the two first conductor contact surfaces 20, 42, and the second conductor B is clamped between the two second conductor contact surfaces 26, 36.

The first sections 16, 32 can preferably resiliently deform to form a spring load against the conductors A, B; similar to an electrical wedge connector. This causes the two second sections 18, 34 to frictionally engage with each other to prevent reverse movement of the members 12, 14 in a direction reverse to direction 48. Additional or alternative locking or latching of the members 12, 14 to each other at the final assembled position shown in FIGS. 1-3 could be provided. In the final assembly, the two conductors A, B are electrically and mechanically connected to each other by the two members 12, 14.

It should be understood that the foregoing description is only illustrative of the invention. Various alternatives and modifications can be devised by those skilled in the art without departing from the invention. For example, features recited in the various dependent claims could be combined with each other in any suitable combination(s). In addition, features from different embodiments described above could be selectively combined into a new embodiment. Accordingly, the invention is intended to embrace all such alternatives, modifications and variances which fall within the scope of the appended claims.

What is claimed is:

1. An electrical connector element comprising:

a first section having a general hook shape with a first conductor contact surface on an inward facing surface of the general hook shape;

an integrally formed second section having a first side forming a second conductor contact surface and an opposite second side, wherein the second side faces the first conductor contact surface, wherein the second side is sized and shaped to slidably interlock directly with another electrical connector element, and wherein the second side has at least one wedging surface which is inclined from a first end of the electrical connector element to an opposite second end of the electrical connector element.

2. An electrical connector element as in claim 1 wherein the at least one wedging surface comprises two wedging surfaces which are stepped relative to each other.

3. An electrical connector element as in claim 1 wherein the electrical connector element is a one-piece metal member.

4. An electrical connector element as in claim 1 wherein the second conductor contact surface is concave shaped.

5. An electrical connector element as in claim 1 wherein the first conductor contact surface is concave shaped.

6. An electrical connector comprising:

a first member comprising the electrical connector element as in claim 1; and a second member slidably connected to the second section;

wherein the second member comprises another electrical connector element.

7. An electrical connector as in claim 6 wherein the second member has a general same shape as the first member.

8. An electrical connector as in claim 6 wherein the first and second members form the entirety of the electrical connector.

9. An electrical connector as in claim 6 wherein the second section of the first member and a second interlocked section of the second member are shaped to move the first conductor contact surface of the first member towards a second conductor contact surface of the second member when the first and second members are slid relative to each other.

10. An electrical connector assembly comprising:

a first one-piece member comprising:

a first hook shaped section having a first conductor contact surface on an inward facing side, wherein the first conductor contact surface extends in a longitudinal direction along a longitudinal length of the first member between front and rear ends of the first member; and a first wedging interlock section located opposite the first conductor contact surface, wherein the first wedging interlock section comprises a second conductor contact surface on an outward facing side of the first wedging interlock section; and a second one-piece member comprising:

a second hook shaped section having a second conductor contact surface on an inward facing side; and a second wedging interlock section located opposite the first conductor contact surface of the second hook shaped section, wherein the second wedging interlock section comprises a first conductor contact surface on an outward facing side of the second wedging interlock section, wherein the second wedging interlock section is directly slidably connected to the first wedging interlock section, and wherein the first and second wedging interlock sections are shaped to move the first conductor contact surfaces of the first and second one-piece members towards each other when the first and second one-piece members are slid relative to each other in the longitudinal direction.

11. An electrical connector assembly as in claim 10 wherein the first wedging interlock section comprises at least two wedging surfaces which are stepped relative to each other.

12. An electrical connector assembly as in claim 10 wherein the second conductor contact surface of the first one-piece member is concave shaped.

13. An electrical connector assembly as in claim 12 wherein the first conductor contact surface of the first one-piece member is concave shaped and faces a same direction as the second conductor contact surface of the first one-piece member.

14. An electrical connector as in claim 10 wherein the second one-piece member has a general same shape as the first one-piece member.

15. An electrical connector as in claim 10 wherein the first and second one-piece members form the entirety of the electrical connector.

16. A method comprising:

forming a first member with a first section having a general hook shape forming a first conductor contact surface on an interior surface of the general hook shape; and integrally forming a second section having a first side forming a second conductor contact surface and an opposite second side, wherein the second side faces the first conductor contact surface, wherein the second side is sized and shaped to slidably interlock directly with a second member, and wherein the second side has two wedging surfaces which are stepped relative to each other.

17. A method as in claim 16 wherein forming the second section comprises the second side being formed with two wedge shaped surfaces facing a same direction and which are stepped relative to each other.

18. A method as in claim 16 further comprising providing the second member and connecting the second member with the first member, wherein the second member has a substantially same shape as the first member.

19. A method as in claim 18 wherein the first and second members are slidably directly interlocked with each other.

20. A method as in claim 19 wherein the first and second members are arranged generally reverse to each other.

* * * * *